US005088366A

United States Patent [19]

Weiss

[11] Patent Number: 5,088,366

[45] Date of Patent: Feb. 18, 1992

[54] PINFEED HOLE PUNCH ASSIST

[75] Inventor: Marvin E. Weiss, Menomonee Falls, Wis.

[73] Assignee: Tailored Label Products, Inc., Menomonee Falls, Wis.

[21] Appl. No.: 591,075

[22] Filed: Oct. 1, 1990

[51] Int. Cl.[5] ..... B26F 1/00

[52] U.S. Cl. ..... 83/326; 83/373; 83/691; 225/94

[58] Field of Search ..... 83/33, 23, 105, 901, 83/405, 406, 691, 326, 373; 225/1, 94

[56] References Cited

U.S. PATENT DOCUMENTS

| | | | |
|---|---|---|---|
| 1,809,040 | 6/1931 | Husler . | |
| 2,085,863 | 7/1937 | Lindbom | 164/99 |
| 2,150,016 | 3/1939 | Wood | 83/33 |
| 2,202,889 | 6/1940 | Bates | 164/89 |
| 3,424,043 | 1/1969 | Martin | 83/659 |
| 4,108,343 | 8/1978 | Vossen | 225/1 |
| 4,723,697 | 2/1988 | Tano et al. | 226/74 |
| 4,790,466 | 12/1988 | Ueno et al. | 226/74 |
| 4,874,121 | 10/1989 | Rubinshtein | 226/74 |
| 4,925,326 | 5/1990 | Bischof et al. | 400/616.1 |

*Primary Examiner*—Hien H. Phan
*Attorney, Agent, or Firm*—Michael, Best & Friedrich

[57] ABSTRACT

A label press for manufacturing labels on an elongated web of release liner having thereon label stock and having a longitudinal axis, the press comprising a roller for moving the web in the direction of the axis, apparatus for manufacturing labels from the label stock, apparatus for cutting pinfeed holes in the web, and apparatus for removing cut-outs from the pinfeed holes.

20 Claims, 2 Drawing Sheets

PINFEED HOLE PUNCH ASSIST

BACKGROUND OF THE INVENTION

The invention relates to apparatus for cutting pinfeed holes in paper or similar material. The invention also relates to label presses used to manufacture an elongated sheet of paper having thereon a plurality of labels and having therein pinfeed holes.

Known label presses produce an elongated sheet or web of paper liner having thereon a plurality of adhesive-backed or pressure-sensitive labels made of various flexible materials including paper, metals and plastics. It is also known to provide such label presses with cutting dies for forming pinfeed holes in the web. The pinfeed holes allow the web to be fed through a printer by conventional drive mechanisms for subsequent printing on the labels. The cutting dies do not always completely remove the circles of cut paper or cut-outs from the pinfeed holes. The remaining cut-outs are known as "hangers". Hangers are undesirable because they usually become separated from the web when the web is fed through a computer printer. This can damage the printer or hinder the printing process.

SUMMARY OF THE INVENTION

The invention provides a pinfeed hole punch assist apparatus which can be attached to a label press such as described above for removing hangers from the pinfeed holes. The pinfeed hole punch assist apparatus can also be attached to any other apparatus that cuts pinfeed holes, or to converting equipment such as fanfold tables.

The preferred embodiment of the invention is a label press. The press has thereon a roll of liner paper and label stock which are preferably separated by a layer of adhesive. The press converts this into an elongated web of liner paper having thereon a plurality of labels and having therein pinfeed holes. The web is pulled through the press by drive rollers and is wound onto a take-up or rewind roll. The press comprises one or more printing apparatus (usually one for each color to be printed on the labels) for applying ink to the label stock. The press also comprises a cutting apparatus for cutting the label stock to form the labels. The waste or label stock surrounding the cut labels is removed from the liner paper. The press also comprises a cutting apparatus for cutting pinfeed holes in the liner paper.

The press also comprises the above mentioned pinfeed hole punch assist apparatus. The apparatus includes opposite frame members mounted on the press on opposite sides of the web. A pair of spacer rods extend between the frame members. Also extending between the frame members are an idler shaft and a driven shaft. Each of the ends of the driven shaft is rotatably connected to the associated frame member by a bearing.

The apparatus also includes a pair of punch assist mechanisms mounted on the driven shaft and the idler shaft. One of the punch assist mechanisms is aligned with the pinfeed holes in one side of the web, and the other punch assist mechanism is aligned with the pinfeed holes in the other side of the web. The mechanisms are substantially identical except for being mirror images of each other.

Each punch assist mechanism includes an endless belt reeved around the idler shaft and the driven shaft such that movement of the belt around the idler shaft and the driven shaft causes rotation of the driven shaft. The belt has thereon a plurality of outwardly extending projections which are spaced apart the same distance as the pinfeed holes are spaced apart and which extend into the pinfeed holes such that movement of the web through the press causes the belt to travel around the idler shaft and the driven shaft. As the web moves through the punch assist mechanism, the projections extend into the pinfeed holes and remove hangers.

A principal feature of the invention is the provision of a label press including an apparatus for removing hangers from pinfeed holes.

Other features and advantages of the invention will become apparent to those skilled in the art upon review of the following detailed description, claims and drawings.

DESCRIPTION OF DRAWING

FIG. 7 is a cross-sectional view of the release liner and label stock.

Figure 1:
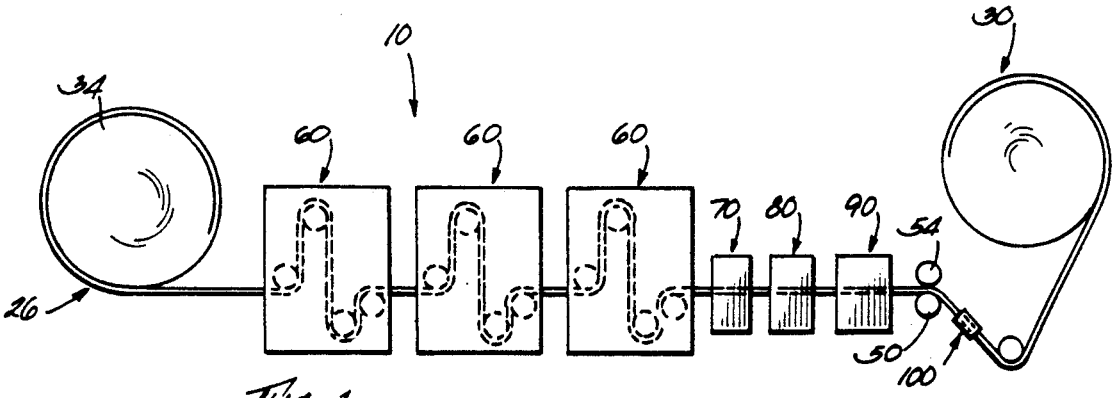
FIG. 1 is a partially schematic side elevational view of a label press embodying the invention.

Before at least one embodiment of the invention is explained in detail, it is to be understood that the invention is not limited in its application to the details of construction and the arrangements of components set forth in the following description or illustrated in the drawings. The invention is capable of other embodiments and of being practiced and carried out in various ways. Also, it is to be understood that the phraseology and terminology employed herein is for the purposes of description and should not be regarded as limiting.

DESCRIPTION OF THE PREFERRED EMBODIMENT

A label press 10 embodying the invention is illustrated in the drawings.

Figure 2:
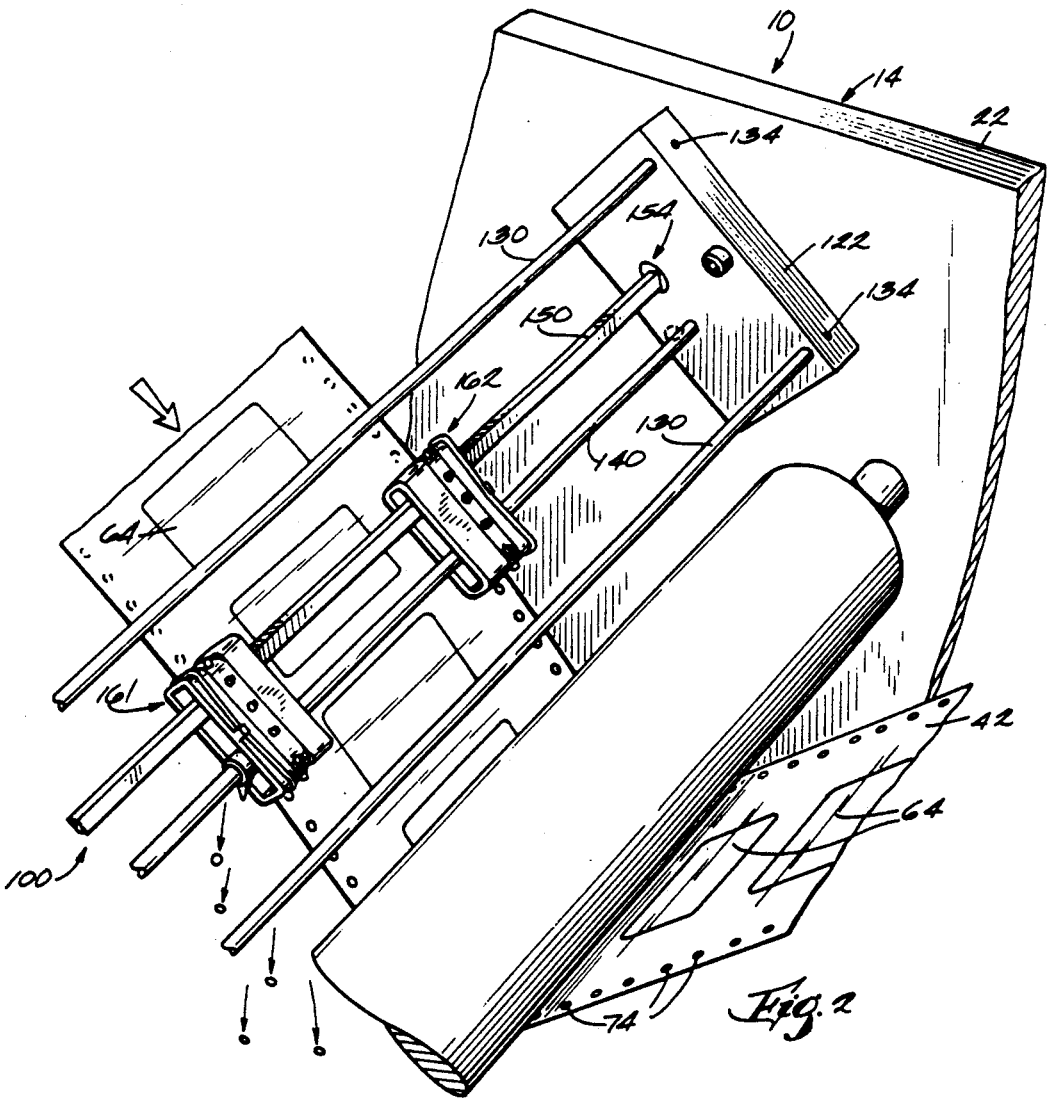
FIG. 2 is a partial perspective view of the press.
Figure 1:
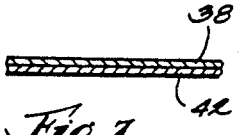
Figure 3:
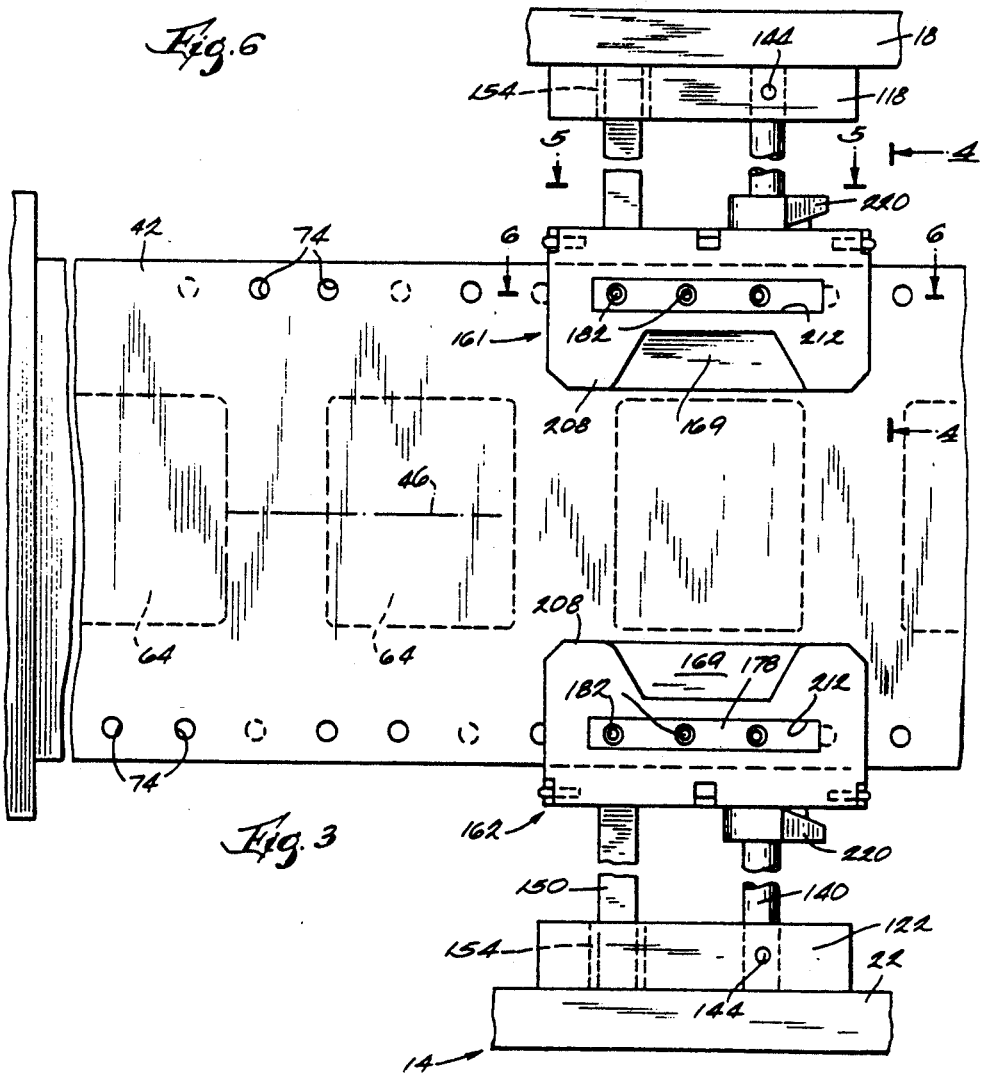
FIG. 3 is a plan view of the underside of the web shown in FIG. 2.

The label press 10 comprises (see FIGS. 2 and 3) a frame 14 including opposite side walls 18 and 22. The press also comprises (see FIG. 1) a supply roller 26 and a take-up or rewind roller 30. The rewind roller 30 is rotationally driven in the counterclockwise direction as shown in FIG. 1. The supply roller 26 has thereon a roll 34 of two-ply material including (see FIG. 7) a layer of adhesive-backed or pressure-sensitive label stock 38 and a layer or web of liner paper or release liner 42. The label stock 38 can be any flexible material such as paper, metal or plastic. The liner paper 42 is similar to wax paper and the adhesive side of the label stock 38 removably adheres to the liner paper or release liner 42. The release liner 42 is wound onto the rewind roller 30 so that the rewind roller 30 takes up the finished product at the end of the press 10.

The press 10 also comprises means for moving the release liner 42 and the label stock 38 through the press 10 in the direction of the longitudinal axis 46 of the web 42. While various suitable means can be employed, in the preferred embodiment, such means includes (see FIG. 1) a friction roller 50 engaging the underside of the release liner 42 and a pacing roller 54 engaging the upper surface of the label stock 38 so as to maintain the release liner 42 in engagement with the friction roller 50. The friction roller 50 is rotationally driven so as to pull the release liner 42 and the label stock 38 through the press 10. Additional pairs of friction rollers and pacing rollers can be employed if desired.

The press 10 also comprises one or more printing apparatus 60 for applying ink to the upper surface of the label stock 38. Typically, one printing apparatus 60 is used for each color of ink to be applied to the label stock 38.

The press 10 also comprises means for cutting labels 64 from the label stock 38. While various suitable means can be used, in the illustrated construction, such means includes a die cutting apparatus 70 which cuts downwardly through the label stock 38, but not through the release liner 42, so as to cut the label stock into a plurality of labels 64 (FIGS. 2 and 3) spaced in the direction of travel of the web 42 through the press 10. In the illustrated construction the labels 64 are generally rectangular.

The press 10 also comprises means for cutting pinfeed holes 74 (FIGS. 2, 3 and 6) in the opposite sides of the release liner or web 42. While various suitable cutting means can be employed, in the preferred embodiment, such means includes (see FIG. 1) a die cutting apparatus 80 which cuts upwardly through the release liner 42 and through the adhesive, but not through the label stock 38, so as to provide, in the release liner 42, circular cuts corresponding to the pinfeed holes 74. Subsequent removal of the circular cut-outs 84 (FIG. 6) provides the pinfeed holes 74.

The press 10 also comprises means 90 for stripping the waste, i.e., the excess label stock 38, from around the cut labels 64. Any conventional means can be employed for this purpose. When the excess label stock 38 is removed from the release liner 42, the cut-out circles 84 of label stock and release liner should, in theory, be removed from the pinfeed holes 74 so as to leave only release liner 42 having therein pinfeed holes 74 on the opposite sides of the labels 64. However, in practice, the cut-outs 84 are not always removed from the pinfeed holes 74. The remaining cut-outs or hangers 84 are, as described above, undesirable because they can damage printers and hinder subsequent printing processes. The press 10 as thus far described is conventional and will not be described in greater detail.

The press 10 also comprises means located downstream of the pinfeed hole cutting means 80 for removing hangers 84 from the pinfeed holes 74. This means preferably includes a pinfeed hole punch assist apparatus 100 mounted between the opposite side walls 18 and 22 of the press 10. The apparatus 100 includes (see FIGS. 2 and 3) a first frame member 118 fixedly mounted on the first side wall 18 of the press 10, and a second frame member 122 fixedly mounted on the second side wall 22 of the press 10. The frame members 118 and 122 are preferably rectangular blocks. The apparatus 100 also includes a pair of spacer rods 130 extending between the frame members 118 and 122 and extending generally perpendicular to the longitudinal axis 46 of the release liner or web 42. In the illustrated construction, each end of each spacer rod 130 is received in a bore in the associated frame member and is secured relative to the frame member by a screw 134 threaded into the frame member.

The apparatus 100 also includes a support shaft 140 extending between the frame members 118 and 122 and generally perpendicular to the direction of movement of the web 42. Each end of the support shaft 140 is received in a bore in the associated frame member and is secured relative to the frame member by a screw 144.

The apparatus 100 further includes a driven shaft 150 extending between the frame members 118 and 122 and generally perpendicular to the direction of movement of the web 42. The driven shaft 150 has a noncircular, and preferably square, cross section. Each end of the driven shaft 150 is rotatably connected to the associated frame member by a bearing 154 housed in a circular bore in the frame member.

The apparatus 100 also includes first and second punch assist mechanisms 161 and 162 mounted on the driven shaft 150 and on the support shaft 140. The mechanism 161 is located on one side of the release liner 42, and the mechanism 162 is located on the other side of the release liner 42. These mechanisms 161 and 162 are, except for their application as described herein, substantially identical to the mechanisms used in a conventional computer printer for feeding paper through the printer. A suitable mechanism is manufactured by Okidata of OKI America, Mt. Laurel, NJ 08054. The mechanisms 161 and 162 are mirror images of each other and only the mechanism 161 will be described in detail.

Figure 4:
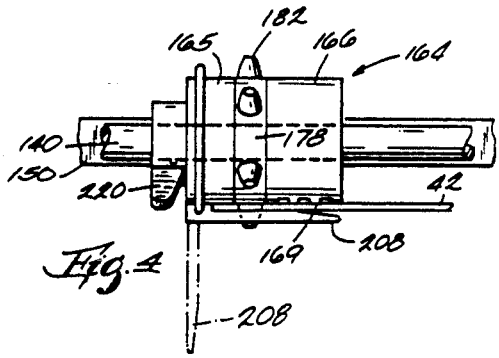
FIG. 4 is a view taken along line 4—4 in FIG. 3.

The mechanism 161 includes (see FIGS. 4--6) a supporting block 164 including first and second portions 165 and 166 that snap together. The first portion 165 has thereon a projection 167 having an arcuate outer surface 168 which defines a portion of a circle. The projection 167 abuts the second portion 166 of the block 164. The block portions 165 and 166 are supported on the support shaft 140 and are, as described below, supported on the driven shaft 150. The block 164 has a generally planar lower surface 169 which slidably engages the release liner 42.

The mechanism 161 also includes (see FIG. 6) a driven sprocket 174 mounted on and between the block portions 165 and 166 for rotation relative thereto. In the illustrated construction, the driven sprocket 174 has therethrough a square aperture through which the driven shaft 150 extends. The sprocket 174 is therefore also mounted on the driven shaft 150 for common rotation therewith.

Figure 6:
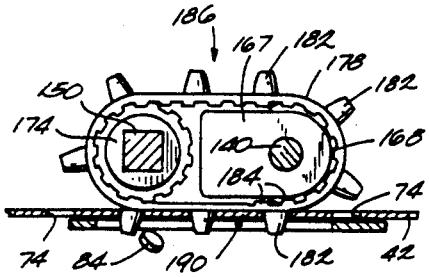
FIG. 6 is a view taken along line 6—6 in FIG. 3.

The mechanism 161 also includes (see FIGS. 4 and 6) an endless belt 178 reeved around the sprocket 174 and the arcuate surface 168. The belt 178 is preferably made of a flexible plastic and includes an endless outer surface having thereon a plurality of outwardly extending projections 182 spaced apart the same distance as the pinfeed holes 74 are spaced apart. The belt 178 also has an inner surface having thereon spaced projections 184 that drivingly engage the teeth on the sprocket 174. The belt 178 has an upper side or portion 186 facing away from the release liner 42 and a lower side or portion 190 facing the release liner 42. As shown in FIG. 6, the projections 182 on the lower side 190 of the belt 178 extend into the pinfeed holes 74 in the release liner 42 so as to remove hangers 84. Engagement of the projections 182 on the lower side of the belt 178 by the release liner 42 causes the belt 178 to travel around an endless path defined by the arcuate surface 168 and the driven sprocket 174, and such travel of the belt 178 causes rotation of the sprocket 174. Rotation of the sprocket 174 causes rotation of the driven shaft 150.

The mechanism 161 also includes (see FIGS. 3 and 4) a retaining member 208 mounted on the block 164 for pivotal movement between a retaining position and a release position. When the retaining member 208 is in its retaining position, the retaining member 208 maintains the release liner 42 in sliding engagement with the lower surface 169 of the block 164 so that the projections 182 on the lower side of the belt 178 extend into the pinfeed holes 74 in the release liner 42. The retaining member 208 has therein (see FIG. 3) a rectangular window 212 through which the projections 182 on the belt 178 extend when the retaining member 208 is in its retaining position.

Figure 5:
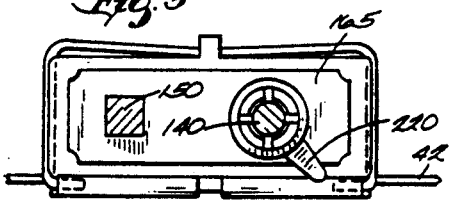
FIG. 5 is a view taken along line 5—5 in FIG. 3.

The mechanism 161 also includes means for releasably locking the mechanism 161 axially of the driven shaft 150 and the support shaft 140. This means preferably includes (see FIGS. 3 and 5) a locking member 220 pivotally mounted on the block 164 and movable between a locking position wherein movement of the mechanism 161 axially of the shafts 140 and 150 is substantially prevented, and a release position wherein movement of the mechanism 161 axially of the shafts 140 and 150 is permitted. Thus, the spacing between the mechanisms 161 and 162 can be adjusted to accommodate release liners 42 having various widths.

Alternatively, the apparatus 100 could include a pair of wheels having endless outer surfaces having thereon projections that extend into the pinfeed holes 74 to remove hangers 84.

It should be understood that the relative location of the various components of the press 10 could be changed. For example, the punch assist apparatus 100 could be located upstream of the rollers 50 and 54. Also, the press 10 could comprise other components, such as an apparatus for perforating the release liner 42.

Various features of the invention are set forth in the following claims.

I claim:

1. A label press for manufacturing labels on an elongated web of release liner having thereon label stock and having a longitudinal axis, said press comprising means for moving the web in the direction of the axis, means for forming labels from the label stock, means for cutting pinfeed holes in the web, and means located downstream of said cutting means for removing cut-outs from said pinfeed holes, said removing means including an endless surface having thereon a plurality of projections adapted to extend into said pinfeed holes to remove cut-outs, said surface moving along an endless path in response to movement of the web.

2. A press as set forth in claim 1 wherein said removing means includes projection means adapted to extend into said pinfeed holes to remove cut-outs.

3. A press as set forth in claim 1 wherein said removing means also includes an endless belt including said endless surface and including a portion which is located adjacent the web and which moves in the direction of movement of the web.

4. A press as set forth in claim 3 wherein said press further comprises a frame, and wherein said removing means also includes a shaft which is supported by said frame and which extends generally perpendicular to the direction of movement of the web, and wherein said belt is reeved around said shaft.

5. A press as set forth in claim 5 wherein movement of said belt in response to movement of the web causes rotation of said shaft.

6. A press as set forth in claim 5 wherein said removing means also includes a support block which is supported relative to said shaft and which has a generally planar surface adapted to slidably engage the web, and a retaining member mounted on said block for movement relative thereto and relative to a retaining position wherein said retaining member secures the web relative to said block.

7. Apparatus for removing cut-outs from pinfeed holes in a sheet of material, said apparatus comprising a frame, and projection means mounted on said frame and adapted to extend into the pinfeed holes for removing the cut-outs, said means including an endless surface having thereon a plurality of projections adapted to extend into the pinfeed holes to remove cut-outs, said surface moving along an endless path in response to movement of the sheet.

8. Apparatus as set forth in claim 7 wherein said means also includes an endless belt including said endless surface and including a portion which is located adjacent the sheet and which moves in the direction of movement of the sheet.

9. Apparatus as set forth in claim 8 wherein said means also includes a shaft which is supported by said frame and which extends generally perpendicular to the direction of movement of the sheet, and wherein said belt is reeved around said shaft.

10. A press as set forth in claim 9 wherein movement of said belt in response to movement of the sheet causes rotation of said shaft.

11. Apparatus as set forth in claim 8 wherein said means also includes a support block which is supported relative to said shaft and which has a generally planar surface adapted to slidably engage the sheet, and a retaining member mounted on said block for movement relative thereto and relative to a retaining position wherein said retaining member secures the sheet relative to said block.

12. Apparatus comprising means for moving an elongated sheet of material having a longitudinal axis in the direction of the axis, means for cutting pinfeed holes in the sheet, and means located downstream of said cutting means for removing cut-outs from said pinfeed holes, said removing means including an endless surface having thereon a plurality of projections adapted to extend into said pinfeed holes to remove cut-outs, said surface moving along an endless path in response to movement of the sheet.

13. Apparatus as set forth in claim 12 wherein said removing means includes projection means adapted to extend into said pinfeed holes to remove cut-outs.

14. Apparatus as set forth in claim 12 wherein said removing means also includes an endless belt including said endless surface and including a portion which is located adjacent the sheet and which moves in the direction of movement of the sheet.

15. Apparatus as set forth in claim 14 wherein said apparatus further comprises a frame, and wherein said removing means also includes a shaft which is supported by said frame and which extends generally perpendicular to the direction of movement of the sheet, and wherein said belt is reeved around said shaft.

16. Apparatus as set forth in claim 15 wherein movement of said belt in response to movement of the sheet causes rotation of said shaft.

17. Apparatus as set forth in claim 14 wherein said removing means also includes a support block which is supported relative to said shaft and which has a generally planar surface adapted to slidably engage the sheet, and a retaining member mounted on said block for movement relative thereto and relative to a retaining position wherein said retaining member secures the sheet relative to said block.

18. A label press for manufacturing labels on an elongated web of release liner having thereon label stock and having a longitudinal axis, said press comprising a frame, means mounted on said frame for moving the web in the direction of the axis, means mounted on said frame for forming labels from the label stock, means mounted on said frame for cutting pinfeed holes in the web, and means mounted on said frame for removing cut-outs from said pinfeed holes, said removing means including a driven shaft which is supported by said frame and which extends generally perpendicular to the direction of movement of the web, and an endless belt which is reeved around said shaft and which includes an endless outer surface having thereon a plurality of projections adapted to extend into said pinfeed holes to remove cut-outs, said belt moving along an endless path around said shaft and causing rotation of said driven shaft in response to movement of the web.

19. A press as set forth in claim 18 wherein said removing means also includes a support block which is supported relative to said shaft and which has a generally planar surface adapted to slidably engage the web, and a retaining member mounted on said block for movement relative thereto and relative to a retaining position wherein said retaining member secures the web relative to said block.

20. A press as set forth in claim 18 wherein said shaft has thereon a sprocket driven by said belt.

* * * * *